United States Patent [19]

Fineberg

[11] Patent Number: 4,478,286

[45] Date of Patent: Oct. 23, 1984

[54] EQUALIZING VALVE FOR SUBTERRANEAN WELLS

[75] Inventor: Douglas H. Fineberg, Broken Arrow, Okla.

[73] Assignee: Baker Oil Tools, Inc., Orange, Calif.

[21] Appl. No.: 466,248

[22] Filed: Feb. 14, 1983

[51] Int. Cl.[3] ..... E21B 34/12

[52] U.S. Cl. ..... 166/324; 166/325

[58] Field of Search ..... 166/324, 325, 319, 321, 166/373, 374, 386; 137/630.15, 630.14, 630

[56] References Cited

U.S. PATENT DOCUMENTS

| | | | |
|---|---|---|---|
| 709,262 | 9/1902 | Gold | 137/630.15 |
| 2,812,821 | 11/1957 | Nelson | 166/325 |
| 2,879,799 | 3/1959 | Jansen et al. | 137/630.12 |
| 2,979,072 | 4/1961 | Webster | 137/322 |
| 3,078,923 | 2/1963 | Tausch | 166/224 |
| 3,971,438 | 7/1976 | Crowe | 166/224 A |
| 4,308,894 | 1/1982 | Carpentier | 137/630.15 |

FOREIGN PATENT DOCUMENTS 2015065 10/1970 Fed. Rep. of Germany .

*Primary Examiner*—James A. Leppink
*Assistant Examiner*—Thuy M. Bui
*Attorney, Agent, or Firm*—Norvell & Associates

[57] ABSTRACT

The subterranean well safety valve useful in oil and gas wells employs a rotatable flapper to close a fluid production flow path. A through-the-flapper equalizing valve means is employed to equalize pressure across the closed valve in response to movement of an axially shiftable flow tube actuator. A spring-loaded poppet valve extends through the flapper on the periphery of the flapper in alignment with the end of the flow tube. The equalizing valve is opened upon initial movement of the flow tube followed by full opening of the flapper.

14 Claims, 6 Drawing Figures

EQUALIZING VALVE FOR SUBTERRANEAN WELLS

BACKGROUND OF THE INVENTION

1. Field of the Invention

This invention relates to a subterranean well valve employing a flapper valve to open and close a production fluid conduit.

2. Description of the Prior Art

Subsurface safety valves are employed in oil and gas wells to close a production fluid conduit, such as a production tubing string, in the event of an emergency. These safety valves are positioned at downhole locations where they will be unaffected by damage to the wellhead. Conventional downhole safety valves include ball type and flapper type safety valves, each of which can be rotated to open the flow path. Normally both ball type and flapper type safety valves are actuated by axial movement of a shiftable actuator responsive to an increase in control fluid pressure. Conventional flapper type safety valves generally employ an axially movable flow tube which strikes the downstream surface of the closed flapper to cam the flapper open as it rotates about a hinge pin. U.S. patent application Ser. No. 232,473, filed Feb. 9, 1981 now U.S. Pat. No. 4,411,316, discloses a downhole flapper type safety valve actuated by an axially shifting flow tube. The safety valve disclosed therein is a non-equalizing safety valve.

Equalizing safety valves are valves which permit pressure equalization on the upstream and downstream sides of a valve head prior to shifting the valve head to open the primary fluid conduit In many wells a large pressure differential can exist between the relatively greater pressure on the upstream side of a closed valve and the relatively smaller pressure on the downstream side. Conventional ball and flapper type safety valves employ axially shiftable sleeves to open ports either above or below the closed valve head to permit communication with an equalizing flow path bypassing the closed valve.

U.S. patent application Ser. No. 259,767, filed May 1, 1981, and U.S. patent application Ser. No. 350,670, filed Feb. 22, 1982, now U.S. Pat. No. 4,415,036 disclose flapper type safety valves having a centrally located aperture extending through the valve. Valve stems extending through these apertures can be actuated upon downward movement of a flow tube type actuator to permit equalizing flow through the centrally located aperture passing around the shiftable valve stem. Each of these valves requires use of a separate head attached to the valve stem for engagement with the axially shiftable flow tube actuator.

The invention disclosed and claimed herein employs an offset aperture located adjacent the periphery of the flapper type valve having a plug or poppet valve located therein. The poppet valve is in direct axial alignment with the end face of the axially shiftable actuator and an equalizing flow passage is established through the cylindrical poppet valve itself rather than through the aperture extending through the flapper valve head. The poppet valve disclosed and claimed herein forms a metal-to-metal seal with the flapper adjacent the periphery of the flapper sealing surfaces and are not exposed to high velocity equalizing flows.

SUMMARY OF THE INVENTION

A downhole type safety valve for use in controlling the flow in a subterranean oil or gas well and permitting equalization of pressures directly through the valve head itself is disclosed and claimed herein. The safety valve comprises a cylindrical valve housing having a circular annular valve seat positioned within the bore of the valve housing. A shiftable flapper type valve head is positioned within the valve housing to sealably engage the valve seat when the flapper is in the closed position. The flapper valve head is rotatable about a hinge pin which is affixed to the valve housing. A longitudinally or axially shiftable actuator, in the preferred embodiment comprising a cylindrical flow tube, is employed to shift the flapper valve head to open the main fluid flow passage. Downward movement of the flow tube actuator cams the flapper about the hinge pin to fully open the main flow passage. In the preferred embodiment of this invention, downward movement of the flow tube actuator is initiated by an increase in control fluid pressure.

Equalization of pressures above and below the closed flapper valve head is accomplished by means of an equalizing valve contained within the flapper valve head. A shiftable poppet or plug valve is positioned within an aperture extending from the upper to the lower surface of the flapper valve head. An upstanding poppet valve surface on the downstream side of the flapper protrudes in alignment with the downwardly shiftable flow tube. Upon downward movement of the flow tube actuator, the upraised surface on the poppet valve is engaged by the end face of the flow tube to shift the poppet or plug valve downwardly in the aperture relative to the flapper. Axial and radial passages extend through the poppet or plug valve to provide communication between the upstream and downstream side of the valve when the valve is in the open position. The radially extending flow passages extend through the sides of the poppet valve and when the equalizing valve is in the closed position the equalizing passages are entirely within the flapper aperture thus preventing any fluid communication between the upper and lower surfaces of the valve. The poppet or plug is received within the axially extending flapper aperture and a metal-to-metal seal is formed between the head of the plug and the periphery of the flapper adjacent the aperture. Equalizing flow through the plug bypasses the closely interfitting surfaces between the plug and the aperture and therefore no sealing surfaces are exposed to fluid flow. By positioning the aperture and the plug adjacent the periphery of the flapper, the plug will be in direct alignment with the end face of flow tube such that the protruding upper surface of the plug will strike the flow tube prior to opening the main flapper. The offset position of the equalizing valve also permits the equalizing valve to close while the flapper is in the fully open position in one embodiment of this invention.

DESCRIPTION OF THE PREFERRED EMBODIMENTS

Figure 1:
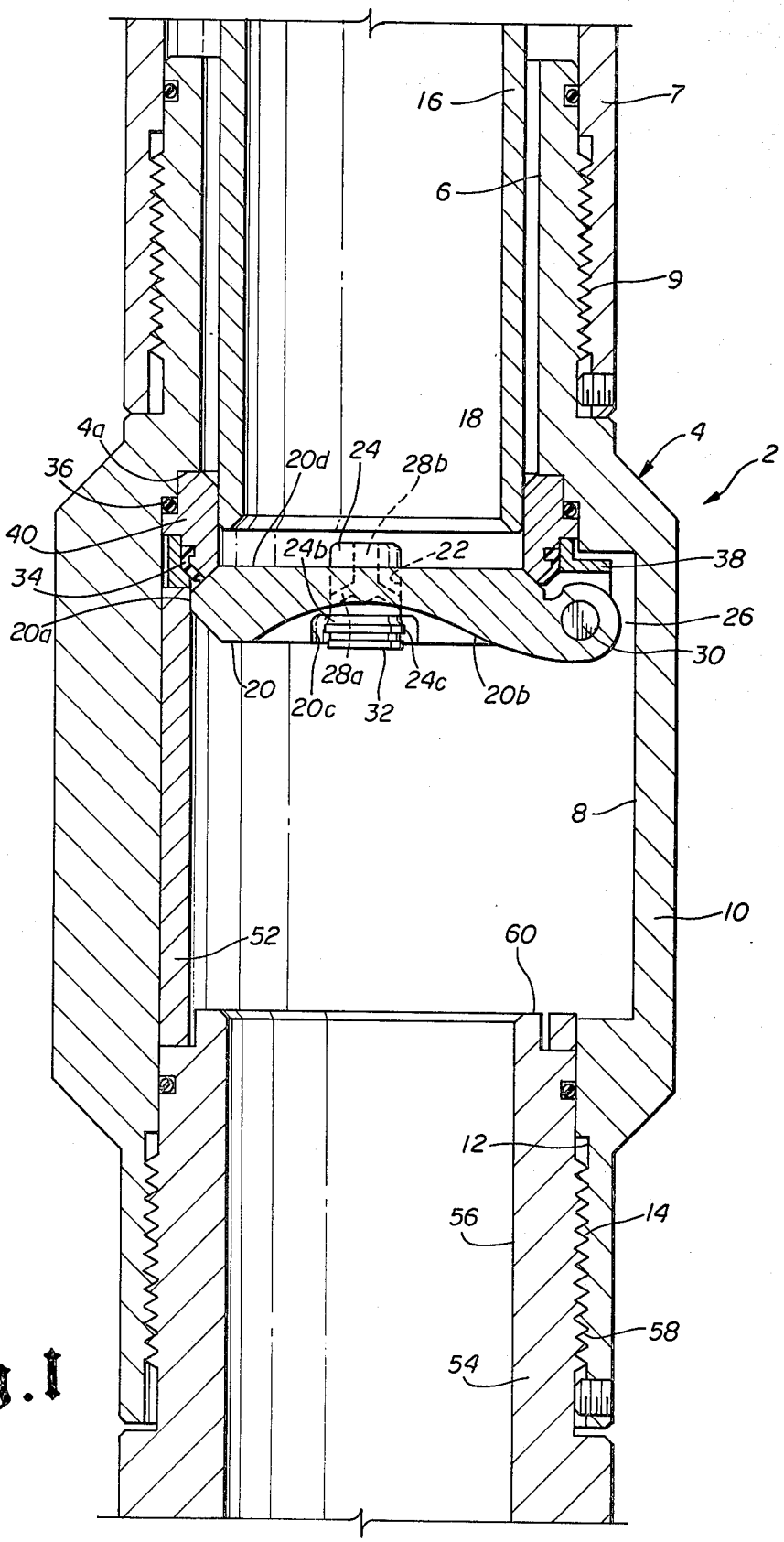
FIG. 1 is a longitudinal sectional view of a subterranean flapper type safety valve with an equalizing valve in the closed position.
Figure 2:
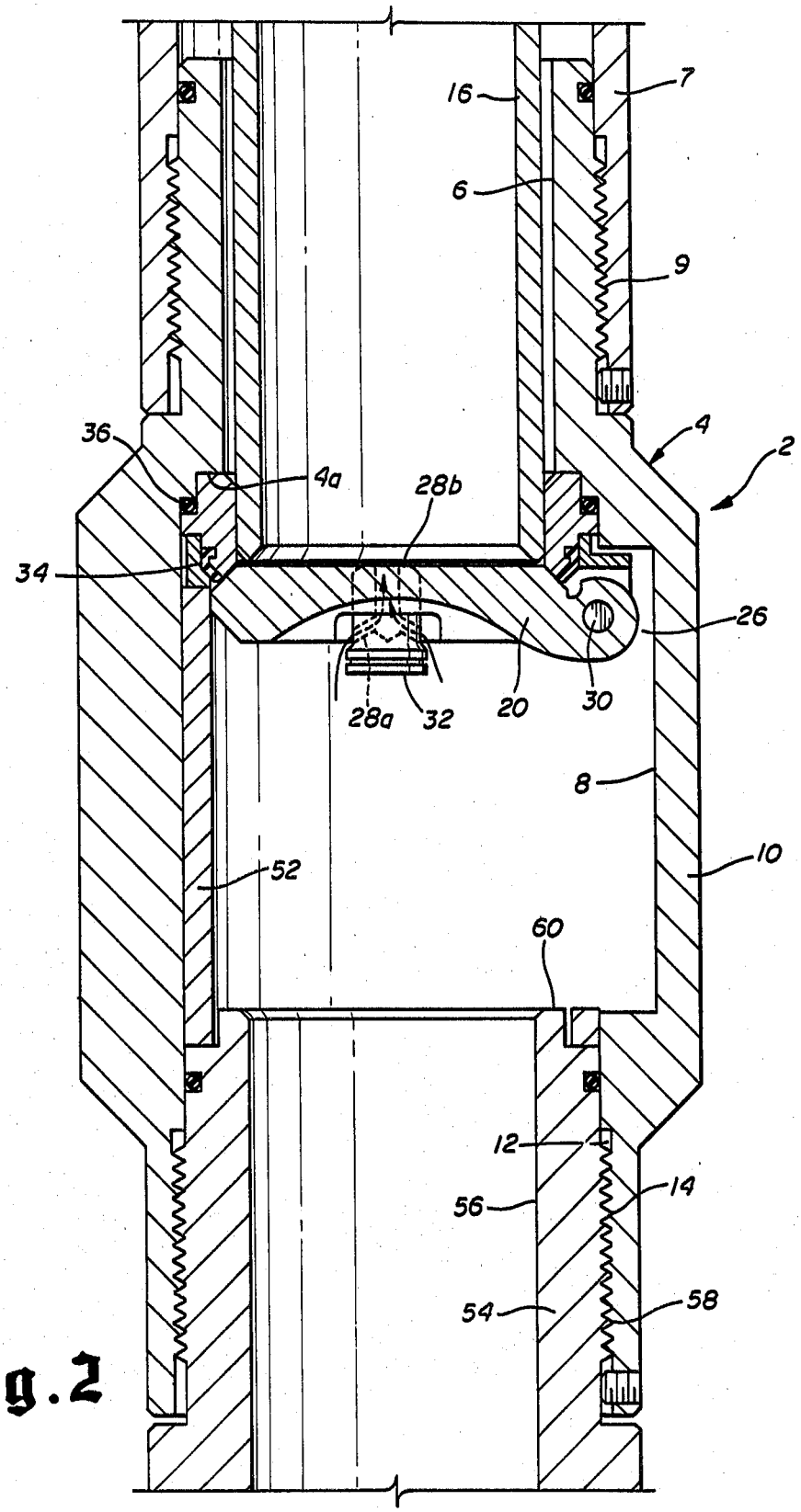
FIG. 2 is a view similar to FIG. 1 showing the equalizing valve in the equalizing position.

The subterranean well safety valve shown in FIG. 2 employs a rotatable flapper valve head to close the producing conduit. Only a portion of an entire safety valve is depicted in FIG. 1. The equalizing flapper closure assembly shown in FIG. 1 can be incorporated into conventional safety valves such as that depicted in U.S. patent application Ser. No. 232,473, filed Feb. 9, 1981, incorporated herein by reference. Conventional flapper type safety valves of that type employ hydraulic actuation of an actuator or flow tube which upon axial movement will rotate the flapper valve head to the fully open position. The flow tube can also be used to isolate the fully opened flapper valve head from flow through the producing conduit.

Conventional flapper type safety valves are generally of two types. Tubing mounted flapper type safety valves can be incorporated as an element or section in a production tubing string. Wireline safety valves which can be mounted in locking nipples incorporated into the tubing string are also used. The flapper assembly disclosed and claimed herein can be employed in either tubing mounted safety valves or in wireline actuated safety valves.

FIG. 1 shows the housing 4 of a safety valve 2 with a flapper valve head 20 mounted within an enlarged portion 10 of the valve housing. An axially shiftable actuator or flow tube 16 extends through the upper portion of flapper valve housing section 10. In the preferred embodiment of this invention, axial movement of flow tube 16 is imparted by an increase in hydraulic control fluid pressure acting upon flow tube 16. Hydraulic control pressure could be communicated to a flow tube actuating surface (not shown) by a conventional hydraulic control line extending from the subterranean location of the safety valve to the surface of the well or of the offshore platform. An increase in control fluid pressure would result in downward movement of flow tube 16 in a conventional manner. FIG. 1 shows the uppermost position of the flow tube 16 with the flapper valve head 20 in the closed position. The lower end face of flow tube 16 is spaced from flapper valve head 20.

Flapper valve head 20 comprises a circular member having an offset hinge 26 receiving a hinge pin 30 therethrough. Flapper 20 is thus rotatably mounted on a base 38 positioned within the enlarged bore 8 of the central section 10 of the safety valve housing. Flapper 20 is free to rotate about hinge pin 30 from the closed position shown in FIG. 1 to the fully open position shown in FIG. 3. Extending around the periphery of flapper 20 is a conical seating surface 20*a* adapted to cooperate with a valve seat 40 and elastomeric seal 34 when the flapper is in the closed position of FIG. 1. An aperture 22, best shown in FIG. 4, extends through the flapper valve head at a position immediately inward of conical seating surface 20*a* and adjacent the periphery of the flapper head. Aperture 22 extends completely through the flapper head. Aperture 22 is located at the rear of flapper 20 as viewed in FIG. 1 and is offset from the plane of the longitudinal section shown in FIG. 1. A plug or poppet 24 is positioned within aperture 22. Plug 24 has a close fit with the inner bore of aperture 22. In the preferred embodiment of the invention shown in FIG. 1, aperture 22 and plug 24 each are circular in cross-sectioned.

Plug 24 has an enlarged lower face section 24*c* and a beveled face 24*b* merging with that portion of the plug extending through aperture 22. An axially extending counterbore 28*b* extends partially through plug 24 from the opposite or upper end. Counterbore 28*b* communicates with one or more radially extending ports 28*a* which extend from the axial counterbore 28*b* to and through the sides of plug 24. In the position shown in FIG. 1, the outer opening of each of the radially extending ports 28*a* is positioned completely within aperture 22. The position of the ports 28*a* in relation to aperture 22 will be discussed in more detail with respect to the alternate embodiment of this invention shown in FIG. 5.

Figure 3:
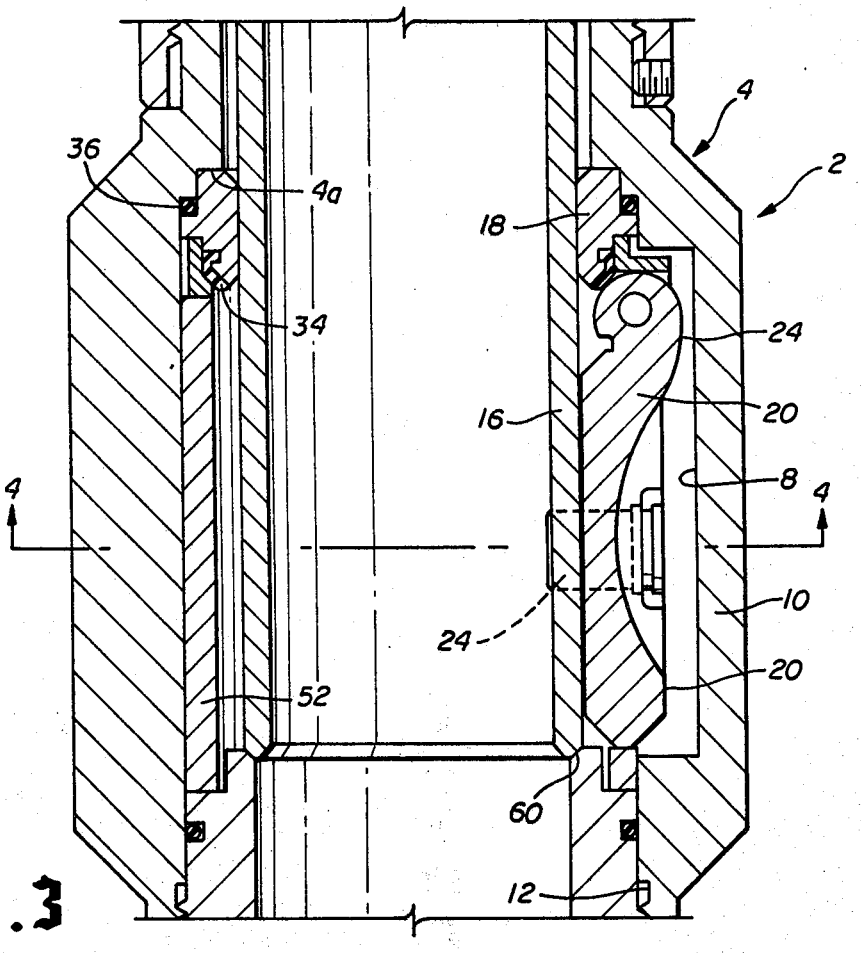
FIG. 3 is a view of the flapper valve in a fully open position with the equalizing valve in the closed position.
Figure 4:
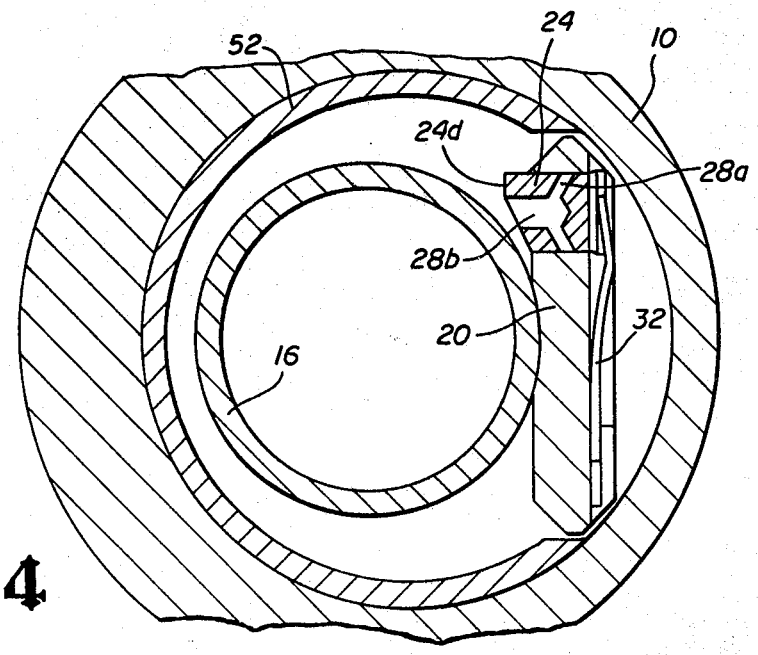
FIG. 4 is a view taken along section 4—4.

Plug 24 is spring-loaded relative to flapper 20 by means of a leaf spring 32, best shown in FIG. 4. In the absence of any downward force acting upon plug 24, spring 32 biases the plug to the closed position shown in FIGS. 1, 3 and 4. Spring 32 extends through a transversely extending recess 20*b* located in the top of flapper 20. In the embodiment of FIG. 1, leaf spring 32 and recess 20*b* are generally parallel to the hinge pin 30.

Figure 5:
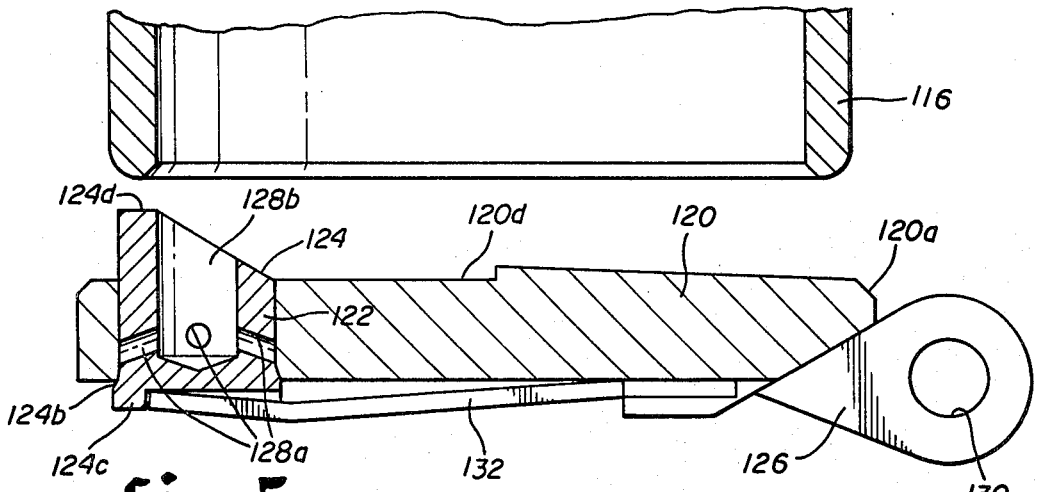
FIG. 5 is a view of an alternate embodiment of a flapper which could be employed within a safety valve.
Figure 6:
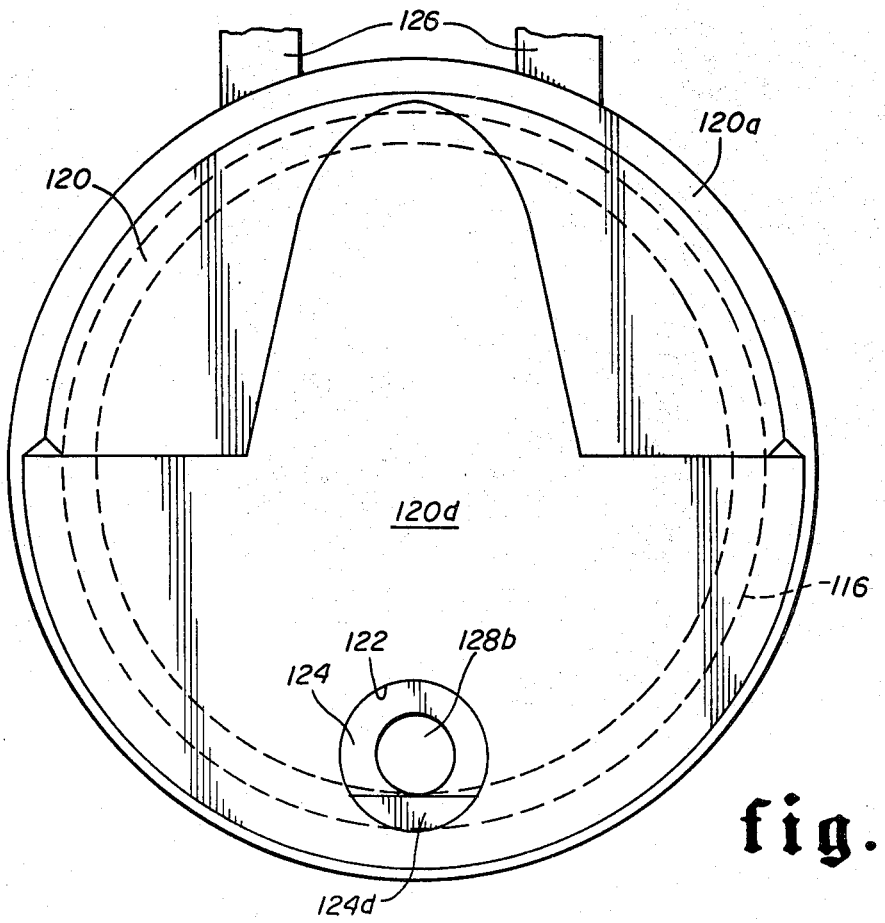
FIG. 6 is a view of the upper surface of the flapper shown in FIG. 5.

The alternate embodiment of the flapper shown in FIGS. 5 and 6 illustrates the orientation of the equalizing valve poppet or plug with respect to the flow tube actuator more clearly than those figures depicting the preferred embodiment of the invention. In the embodiment of FIGS. 5 and 6, the aperture 122 and poppet or plug 124 are positioned adjacent the periphery of flapper 120 at a point opposite hinge 126. A comparison of a transverse sectional view of flappers 120 and 20 would reveal that the position of aperture 22 is rotated by 90° relative to the position of aperture 122. In each of the embodiments, however, the plugs 124 and 24 would be located in alignment with the cylindrical wall of flow tubes 16 and 116. As shown in FIGS. 4 and 5, the upstream end of plugs 24 and 124 are inclined and have an upstanding surface 24*d* and 124*d*, respectively, aligned with the cylindrical wall of the flow tube. Surfaces 24*d* and 124*d* each protrude upwardly from the upstream face of flappers 20 and 120. Therefore the flow tubes will strike these upwardly protruding surfaces prior to striking any other surface on the flapper head.

Poppet or plug 124 of the alternate embodiment is identical to poppet 24 of the preferred embodiment of this invention. FIG. 5, however, illustrates the equalizing flow passages extending through the equalizing plug more clearly than the figures showing the preferred embodiment of this invention. The equalizing flow path comprising counterbore 128*b* and one or more radially extending ports 128*a* is shown in the closed position in FIG. 5. The openings of ports 128*a* on the side walls of plug 124*b* are shown completely within the aperture 122 in FIG. 5. Since the cylindrical plug 124 is adapted to closely fit within the cylindrical bore of aperture 122, the radially extending equalizing ports 128*a* are effectively closed in the position of FIG. 5. Note that each of the radially extending ports is spaced from the lower surface opening of aperture 122. Beveled surface 124*b* extends between the axially extending sides of plug 124 to an enlarged head 124*c*. In the position shown in FIG. 5, these beveled surfaces engage the upper surface of flapper 120 adjacent the periphery of aperture 122. A metal-to-metal seal is established between the beveled surface 124*b* and the periphery of aperture 122 on the downstream side of flapper 120.

Equalizing valve means of each of the embodiments of this invention are actuated in the same manner. When the flow tubes 16 or 116 are actuated, for example by means of an increase in hydraulic control fluid pressure, the lower end face of the flow tube will initially abut the upwardly protruding surfaces 24*d* or 124*d* prior to abutting the upper face of the flapper valve heads. Continued downward movement of flow tube 16 will therefore shift equalizing poppet or plug 24 downwardly from the position shown in FIG. 1 to the position shown in FIG. 2. It is apparent from the position of the flow tube relative to the poppet or plug in each embodiment of this invention, that the actuation of the equalizing valve shown in FIG. 2 is identical to the manner in which the equalizing valve means is actuated in the embodiment of FIG. 5. Downward movement of flow tube 16 into abutment with the upper surface 20*d* of flapper 20 will result in downward movement of equalizing valve poppet 24 against the closing force exerted by leaf spring 32 and well pressure. Downward movement of plug 24 will shift the radially extending ports 28*a* from the closed position within aperture 22 to a position free of aperture 22 as shown in FIG. 2. In this manner communication is established through counterbore 28*b* and radial ports 28*a* between the upstream and downstream sides of the closed flapper. If well pressure has resulted in the presence of a pressure force on the upstream side of the flapper greater than the pressure on the downstream side of the flapper, equalization can thus occur through the equalizing passages formed by counterbore 28*b* and radially extending ports 28*a*. Note that the equalizing flow path extends through the center of poppet or plug 24. The surface of aperture 22 and the outer surfaces of plug 24 are not exposed to equalizing flow. Equalizing flow would therefore not tend to damage these closely interfitting aperture and plug surfaces. In the equalizing position shown in FIG. 2, the radially extending ports 28*a* are also spaced from the metal-to-metal sealing surfaces adjacent the periphery of aperture 22. By directing equalizing flow through the equalizing plug, sealing surfaces are not exposed to the erosive action of high velocity flows or to the sand often carried by these flows in an oil or gas well.

FIG. 3 illustrates the fully open position of the flapper 20. In the embodiment of FIGS. 1–4, the offset plug 24 is in the closed position when the flapper 20 is in the fully open position. Although plug 24 would be initially aligned with the end of flow tube 16 for initial actuation, downward movement of the flow tube past the flapper will result in a disengagement between flow tube 16 and plug 24. Spring 32 can then bring plug 24 to the closed position as best shown in FIG. 4. By maintaining the plug in the closed position during production with the flapper in the open position, buildup of sand or other particles which might tend to clog the equalizing valve in the open position can be avoided.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve positionable within a subterranean well comprising:

a valve housing defining an annular valve seat surrounding a main fluid flow passage;

a shiftable flapper valve head movable to a closed position extending across the main fluid flow passage and sealably engaging the valve seat;

an actuator shiftable mounted within the housing;

means for moving the actuator longitudinally to shift the flapper valve head to open the main fluid flow passage;

an aperture adjacent the periphery of the flapper valve head extending longitudinally through the flapper valve head, the axis of the aperture being parallel to the axis of the flow passage;

equalizing valve means extending through said aperture and longitudinally shiftable from a first position to a second position in which an equalizing flow path through the flapper valve head is opened; and means on the equalizing valve means for engaging the actuator prior to engagement between said actuator and said flapper valve head, said actuator shifting the equalizing valve to said second position to equalize fluid pressure above and below said flapper valve head, the actuator engaging the flapper valve head upon additional longitudinal movement thereof for opening the main fluid flow passage, when the equalizing valve means is in the open position.

2. A valve positionable within a subterranean well comprising:

a valve housing defining an annular valve seat surrounding a main fluid flow passage;

a shiftable flapper valve head movable to a closed position extending across the main fluid flow passage and sealably engaging the valve seat;

an actuator shiftably mounted within the housing;

means for moving the actuator longitudinally to shift the flapper valve head to open the main fluid flow passage;

an aperture adjacent the periphery of the flapper valve head extending longitudinally through the flapper valve head, the axis of the aperture being parallel to the axis of the flow passage;

equalizing valve means extending through said aperture and longitudinally shiftable from a first closed position to a second position in which an equalizing flow path through the flapper valve head is opened; and means for biasing the equalizing valve means relative to the flapper valve head so that the equalizing valve means protrudes beyond the flapper valve head in the closed position, the equalizing valve means being aligned with the periphery of the actuator, whereby the actuation shifts the equalizing valve to the second position to equalize fluid pressure above and below the flapper valve head, the actuator engaging the flapper valve head upon additional longitudinal movement thereof for opening the main fluid flow passage, when the equalizing valve means is in the open position.

3. A valve positionable within a subterranean well comprising:

a valve housing defining an annular valve seat surrounding a main fluid flow passage;

a shiftable valve head movable to a closed position extending across the main fluid flow passage and sealably engaging the valve seat;

an actuator shiftably mounted within the housing;

means for moving the actuator longitudinally through the valve head to open the main fluid flow passage; an aperture extending longitudinally through the valve head;

equalizing valve means extending through said aperture and longitudinally shiftable from a first position to a second position in which an equalizing flow path through the flapper valve head is opened, the equalizing valve means comprising a cylindrical member having an equalizing flow passage extending therethrough, the equalizing flow passages being closed when the equalizing valve means is in a first position in the aperture and open when the equalizing valve means is shifted to a second position relative to the aperture; and means on the equalizing means for engaging the actuator prior to engagement between the actuator and the valve head, the actuator shifting the equalizing valve means to the second position in which the equalizing flow passage is free of the aperture to equalize fluid pressure above and below the valve head, prior to shifting the valve head to open the main fluid flow passage, when the equalizing valve means is in the open position.

4. The valve of claim 3 wherein the equalizing flow passage includes a port extending radially through the equalizing valve means.

5. The valve of claim 4 wherein the equalizing flow passage further comprises an axially extending bore communicating with the radially extending port.

6. The valve of claim 3 wherein the equalizing valve means is spring loaded relative to the valve head for closing the aperture.

7. The valve of claim 3 wherein the actuator comprises a flow tube.

8. A valve for use in controlling the flow through a subterranean well conduit, comprising:

a rotatable flapper movable between an open and a closed position to control flow through the well conduit;

an axially shiftable actuator engagable with the flapper to open the flapper upon axial movement relative thereto;

an aperture extending between the upper and lower surfaces of the flapper;

a cylindrical plug extending through the aperture and shiftable relative thereto;

a port opening radially through a side of the plug and communicating through the plug to another external surface of the plug;

a sealing surface on the plug engaging a mating surface on the flapper to seal the aperture when the plug is in a first position; and a surface on the plug engaging the shiftable actuator prior to engagement between the shiftable actuator and the flapper to shift the plug from the first to a second position in which communication is established between the upper and lower surface of the flapper through the port, the port being free from the aperture when the plug is in the second position, the plug being in the second position when the flapper is moved from the closed position whereby pressure above and below the flapper is equalized through the port before the actuator engages the flapper to fully open the well conduit.

9. The valve of claim 8 wherein the actuator comprises a flow tube and the aperture is adjacent the periphery of the flapper so that the plug is in alignment with the end of the flow tube.

10. The valve of claim 8 wherein the sealing surface on the plug comprises a metal surface adjacent one end of the plug in contact with a cooperable surface of the flapper extending around the periphery of the aperture on one face of the flapper, the port being spaced from the one face of the flapper when the plug is in the first and second positions.

11. A valve positionable within a subterranean well comprising:

a valve housing defining an annular valve seat surrounding a main fluid flow passage;

a shiftable flapper valve head rotatable about a hinge to a closed position extending across the main fluid flow passage and sealably engaging the valve seat;

an actuator shiftably mounted within the housing;

means for moving the actuator longitudinally to shift the flapper valve head to open the main fluid flow passage;

an aperture adjacent the periphery of the flapper valve head extending longitudinally through the flapper valve head, the axis of the aperture being parallel to the axis of the flow passage, and laterally spaced from a plane perpendicularly to the flapper hinge axis containing the axis of the flow passage;

equalizing valve means extending through said aperture and longitudinally shiftable between a closed position to an open position to open an equalizing flow path through the flapper valve head; and means on the equalizing valve means for engaging the actuator prior to engagement between said actuator and said flapper valve head, said actuator shifting the equalizing valve to said second position to equalize fluid pressure above and below said flapper valve head, the actuator engaging the flapper valve head upon additional longitudinal movement thereof for opening the main fluid flow passage when the equalizing valve is in the open position, the actuator being disengaged from the equalizing valve means when the flapper valve head is in the fully open position, so that the equalizing valve means is closed when the flapper valve is open.

12. A valve for use in controlling the flow through a subterranean well conduit, comprising:

a shiftable valve closure member movable between an open and a closed position to control flow through the well conduit;

an axially shiftable actuating means for shifting the valve closure means to the open position upon axial movement relative thereto;

an aperture in communication with the conduit above and below the closed valve closure member;

a cylindrical plug extending into the aperture and shiftable relative thereto;

a port opening radially through a side of the plug and communicating through the plug to another external surface of the plug;

a sealing surface on the plug engaging a mating surface to seal the aperture when the plug is in a first position; and a surface on the plug engaging the shiftable actuator prior to engagement between the shiftable actuator and the valve closure member to shift the plug from the first to a second position in which communication is established through the port in the plug and aperture between the conduit above and below the closed valve closure member, the port being free from the aperture when the plug is in the second position, whereby pressure above and below the valve closure member is equalized through the port before the actuator means opens the valve closure member.

13. A valve for use in controlling the flow through a subterranean well conduit, comprising:

an annular valve seat;

a shiftable valve closure member movable between an open and a closed position to control flow through the well conduit, and engagable with the valve seat in the closed position;

an axially shiftable actuating means for shifting the valve closure means to the open position upon axial movement relative thereto;

an aperture communicating between the upstream and downstream surfaces of the valve closure member and comprising an aperture in the valve closure member located adjacent the periphery thereof in alignment with the axially shiftable actuating means;

a cylindrical plug extending into the aperture and shiftable relative thereto;

a port opening radially through a side of the plug and communicating through the plug to another external surface of the plug;

a sealing surface on the plug engaging a mating surface to seal the aperture when the plug is in a first position; and a surface on the plug engaging the shiftable actuator prior to engagement between the shiftable actuator and the valve closure member to shift the plug from the first to a second position in which communication is established through the port in the plug and aperture between the conduit above and below the closed valve closure member, the port being free from the aperture when the plug is in the second position, whereby pressure above and below the valve closure member is equalized through the port before the actuator means opens the valve closure member.

14. The valve of claim 13 wherein the valve closure member comprises a flapper valve head.

* * * * *